US005134430A

United States Patent [19]

Koizumi

[11] Patent Number: 5,134,430

[45] Date of Patent: Jul. 28, 1992

[54] CONVEYOR RACK FOR CONVEYING SENSITIZED MATERIAL, AND A METHOD OF OPERATING THE CONVEYOR RACK

[75] Inventor: Takashi Koizumi, Kanagawa, Japan

[73] Assignee: Fuji Photo Film Co., Ltd., Kanagawa, Japan

[21] Appl. No.: 641,829

[22] Filed: Jan. 16, 1991

[30] Foreign Application Priority Data

Mar. 19, 1990 [JP] Japan ..... 2-68725
Mar. 19, 1990 [JP] Japan ..... 2-68726

[51] Int. Cl.[5] ..... G03D 3/08
[52] U.S. Cl. ..... 354/320; 354/321
[58] Field of Search ..... 354/319, 320, 321, 322, 354/338, 339, 335, 343

[56] References Cited

U.S. PATENT DOCUMENTS 4,903,064 2/1990 Kogane et al. ..... 354/321

*Primary Examiner*—L. T. Hix
*Assistant Examiner*—D. Rutledge
*Attorney, Agent, or Firm*—Sughrue, Mion, Zinn, Macpeak & Seas

[57] ABSTRACT

A photosensitive material such as film is conveyed while the widthwise edges thereof are guided by width guides. The width guides have an adjusting part such as a screw to adjust the position thereof when the width of the photosensitive material changes. The adjusting part, even when the width dimension of the sensitized material does not change, is driven at a specified interval such as every few hours to remove a precipitate such as a developer which is deposited on the adjusting part.

20 Claims, 3 Drawing Sheets

CONVEYOR RACK FOR CONVEYING SENSITIZED MATERIAL, AND A METHOD OF OPERATING THE CONVEYOR RACK

BACKGROUND OF THE INVENTION

1. Field of the Invention

The present invention relates to a conveyor rack for conveying photosensitive material within a submerged treatment area such as a developing tank or within a dry-treatment room and to a method of operating such a conveyor rack.

2. Background Information

Where, in a developing apparatus, photosensitive material is conveyed to perform developing treatment, a conveyor rack is placed in each treatment tank and guide rollers provided on each conveyor rack hold and convey the photosensitive material.

On the conveyor racks, width guides are provided corresponding to both widthwise edges of the photosensitive material to be held and conveyed, thereby preventing the photosensitive material from meandering.

It is preferable that the width guides be arranged in such a manner that the position thereof can be adjusted according to a change in the width of the photosensitive material. The adjustment of the width guides is accomplished by an operation on the part of a worker who either manually adjusts a manual-adjustment handle mounted on the conveyor rack body above the liquid level, or, alternatively, activates a driving motor.

However, during treatment of the photosensitive material, a precipitate from the treatment liquid accumulates on the engaging portions of the width guides. Although the precipitate is usually removed by taking the conveyor rack out of the treatment liquid and washing it at a specified time interval, this washing job is typically performed only after a relatively long period (a week, for example) has elapsed. Accordingly, the precipitate deposited on the guide engaging portions of the width guides during the intervals between washing, creates a frictional resistance against the movement of the width guides during operation of the adjustment handle, thereby rendering proper adjustment of the position of the guides impossible.

SUMMARY OF THE INVENTION

Considering the above-described fact, a purpose of the present invention is to provide a conveyor rack and a method of operation thereof enabling the conveying of photosensitive material in such a manner that an operation for adjusting the position of the width guides is not disturbed by the accumulation of a precipitate even when the above described washing job is not performed for a relatively long period.

The present invention is a method of operating a conveyor rack used in an automatic developing apparatus, which guides and conveys photosensitive material within a treatment area, and in which the position of width guides for guiding the widthwise edges of the photosensitive material is adjustable according to the width of the photosensitive material, characterized in that the width guides are automatically driven in the position-adjusting direction within a prescribed position-adjusting range, at a specified time intervals to remove a precipitate which has precipitated out of the treatment liquid onto the guide engaging part of the position adjusting member.

Accordingly, in the present invention, the width guides are driven in the position-adjusting direction, within a position-adjusting range at a specified time interval, under the condition that the conveyor rack has guided and conveyed a specified quantity of photosensitive material. The specified time intervals which can be determined to suit each case, may be every specified number of hours or once a day, for example, at the time when the temperature of the treatment liquid is adjusted by warming at the start of operation of the developing apparatus on a working day, or when a stop button for termination of the operation is pressed. As the guide engaging portion of the width guides is moved within the position-adjusting range, a trace quantity of a submerged precipitate accumulated for a specified period until that time (for example, the amount of precipitate accumulated in one day of operation) is forcibly removed. Accordingly, the position of the width guides can be adjusted at any time without being impeded by a large quantity of precipitate left unremoved for a long period.

Ordinarily, the forcible driving of the width guides need be performed only within a particular range of positional adjustments based on the width of the photosensitive material to be treated, but in an apparatus capable of adjustment exceeding that range, however, the width guide may, of course, be driven in a stroke exceeding the maximum extent of the particular range.

The conveyor rack according to the present invention is so arranged that photosensitive material which has become jammed between the holding rollers can be easily removed while the conveyor rack is left in the treating liquid, by releasing the connection between a roller drive shaft and a drive source and by manually turning the material holding roller by a simple operation of a manual roller-turning handle. The connection between the roller drive shaft and the drive source employs an engagement of helical gears or spur gears, so that, when the conveyor rack body is raised so as to be partially out of the treating tank, these gears are disengaged by this movement. The turning of a manual width guide adjustment handle causes the width guides to move thereby making the removal of photosensitive material easy. The job of washing the rack body is similarly performed by manually turning the rollers and adjusting the width guides so as to wash every nook and cranny of the rack body. The roller drive shaft and the width guide drive shaft are arranged in such a manner that intermediate sections thereof penetrate the surface of the liquid vertically, so that, even when the roller drive shaft and the width guide drive shaft are rotated, treatment liquid such as developer will not climb the roller drive shaft or the width guide drive shaft above the liquid level, and no treatment liquid can escape inadvertently from the tank.

DESCRIPTION OF THE PREFERRED EMBODIMENTS

Figure 1:
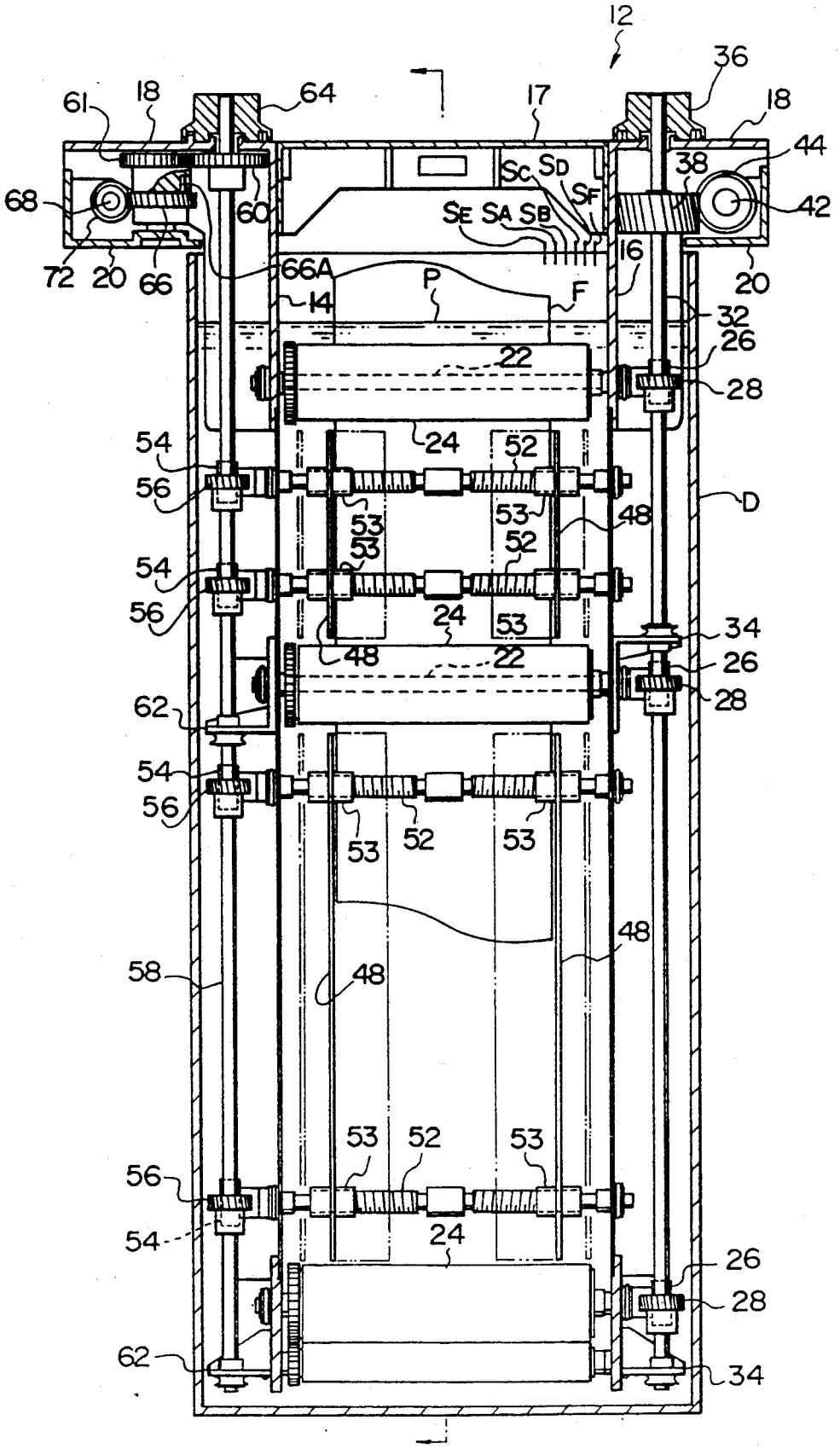
FIG. 1 is a longitudinal sectional view showing a developing tank to which the present invention is applied.
Figure 2:
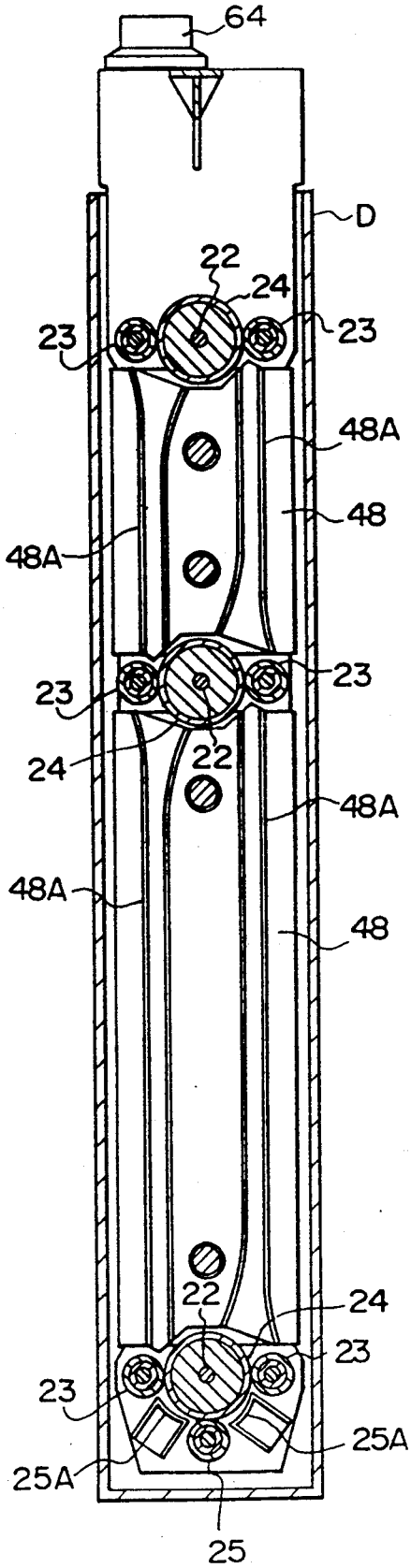
FIG. 2 is a longitudinal sectional view taken on line II—II in FIG. 1.

FIGS. 1 and 2 show a conveyor rack to which the present invention is applied.

The conveyor rack is arranged in such a way that a pair of side plates 14 and 16 comprising parallel feet of a rack body 12 are immersed in a treatment tank D such as a developing tank. The rack body 12 is arranged such that two top parts, thereof (on the right and left in FIG. 1) are connected to each other through a horizontal plate 17 extending across the top (in FIG. 1) of the conveyor rack, and arms 18 extend horizontally out ward from these two top parts so as to reach, and be placed on brackets 20 on either side of the treating tank D which extend from and are fixedly secured to respective side walls of the treating tank D.

A plurality of rotating shafts 22 are supported at their axial ends by the side plates 14 and 16, with the shaft centers thereof positioned horizontally, and conveyor rollers 24 are fixedly secured to the midsections of each of the rotating shafts 22. Press rollers 23 are located adjacent to and on both sides of each of the conveyor rollers 24, that is, both sides along a line penetrating the paper surface of FIG. 1 (at right angles), in parallel to conveyor rollers 24, (see FIG. 2), and supported at axial ends by the side plates 14 and 16 so as to hold photosensitive material F against the conveyor roller 24 and convey the material. A return roller 25 abuts against the lower part (at the bottom of FIG. 2) of the conveyor roller 24 at the lowest point in the conveying cycle and serves to turn back the sensitized material F at the lower end of the rack with the aid of guide plates 25A.

Helical gears 26 are fixedly secured to the right hand ends (in FIG. 1) of the rotating shafts 22 extending through the side plate 14. Each helical gear 26 is engaged with a helical gear 28 whose axial center lies at a right-angle with respect to the axial center of the gear 26 (in the plane of the paper in FIG. 1). The helical gears 28 have their axial centers positioned vertically (in FIG. 1) and are integrally fixed to a roller drive shaft 32 positioned on the right side of the conveying device (in FIG. 1). The roller drive shaft 32 is supported at the lower end and at the middle thereof by brackets 34 extending horizontally from the rack body 12 (in FIG. 1), and the upper end thereof is supported by the arm 18 while a part near the upper end passes vertically through the surface of the treatment liquid P. A turning-handle 36 is fixedly secured to the upper end of the roller drive shaft 32 which extends above the arm 18, so that a worker can turn the turning-handle 36 to transmit the turning force thereof to the conveyor rollers 24 so as to manually turn them.

A helical gear 38 is fixedly secured to the middle of the portion of the roller drive shaft 32 which is above the surface of the liquid, and is engaged with a helical gear 44 fixedly secured on a roller drive shaft 42 lying perpendicular to the page surface of FIG. 1. A motor (not shown) is connected to the roller drive shaft 42 to rotatably drive the conveyor rollers 24 through the helical gear 44, the helical gear 38 and the roller drive shaft 32.

Even when the roller drive shaft 32 is thus rotated, since the axial center of the roller drive shaft 32 in contact with the surface of the treating liquid P is vertical (in FIG. 1), the treatment liquid P cannot climb up the outer periphery of the roller drive shaft 32 above the surface level of the liquid to escape from the tank.

Between the respective conveyor rollers 24, width guide bodies 48 are provided to guide both widthwise edges of the sensitized material F. The width guide bodies 48 are positioned so as to correspond to the respective widthwise edges of the photosensitive material F and are comprised of flat plates onto which U shaped ridge plates 48A are fixedly secured to accommodate and guide the respective widthwise edges of the photosensitive material F. Also, on the width guide bodies 48, sleeves 53 are fixedly secured so as to enwrap and threadedly engage with screw shafts 52 which are placed between and are supported at their axial ends by the side plates 14 and 16. The screw shafts 52 are each constructed so as to have two threaded portions separated by a middle unthreaded portion, and the threads of these two threaded portions are made to be reciprocal mirror images of each other, so that a rotation of screw shafts 52 in one direction causes the corresponding pairs of width guide bodies 48 which are threadedly engaged with each shaft to approach each other, while a rotation in the opposite direction causes these pairs of width guide bodies to move away from each other.

One the left hand ends (in FIG. 1) of the screw shafts 52 extending through the side plate 14, helical gears 54 are fixedly secured. Each helical gear 54 is engaged with a helical gear 56 whose axial center is vertical (in FIG. 1), and the helical gears 56 are fixedly secured on a width guide drive shaft 58. The axial center of width guide drive shaft 58 is vertical as in the case of the roller drive shaft 32, and is supported at the lower end and at the middle thereof by brackets 62 extending horizontally from the rack body 12, (in FIG. 1), and an upper intermediate part thereof passes vertically through the surface of the treatment liquid P and the upper end thereof is supported by the horizontal plate 18. On the upper end of the width guide drive shaft 58, a turning handle 64 is fixedly secured, so that a worker can turn the turning handle 64 to cause the screw shaft 52 to be turned.

Figure 3:
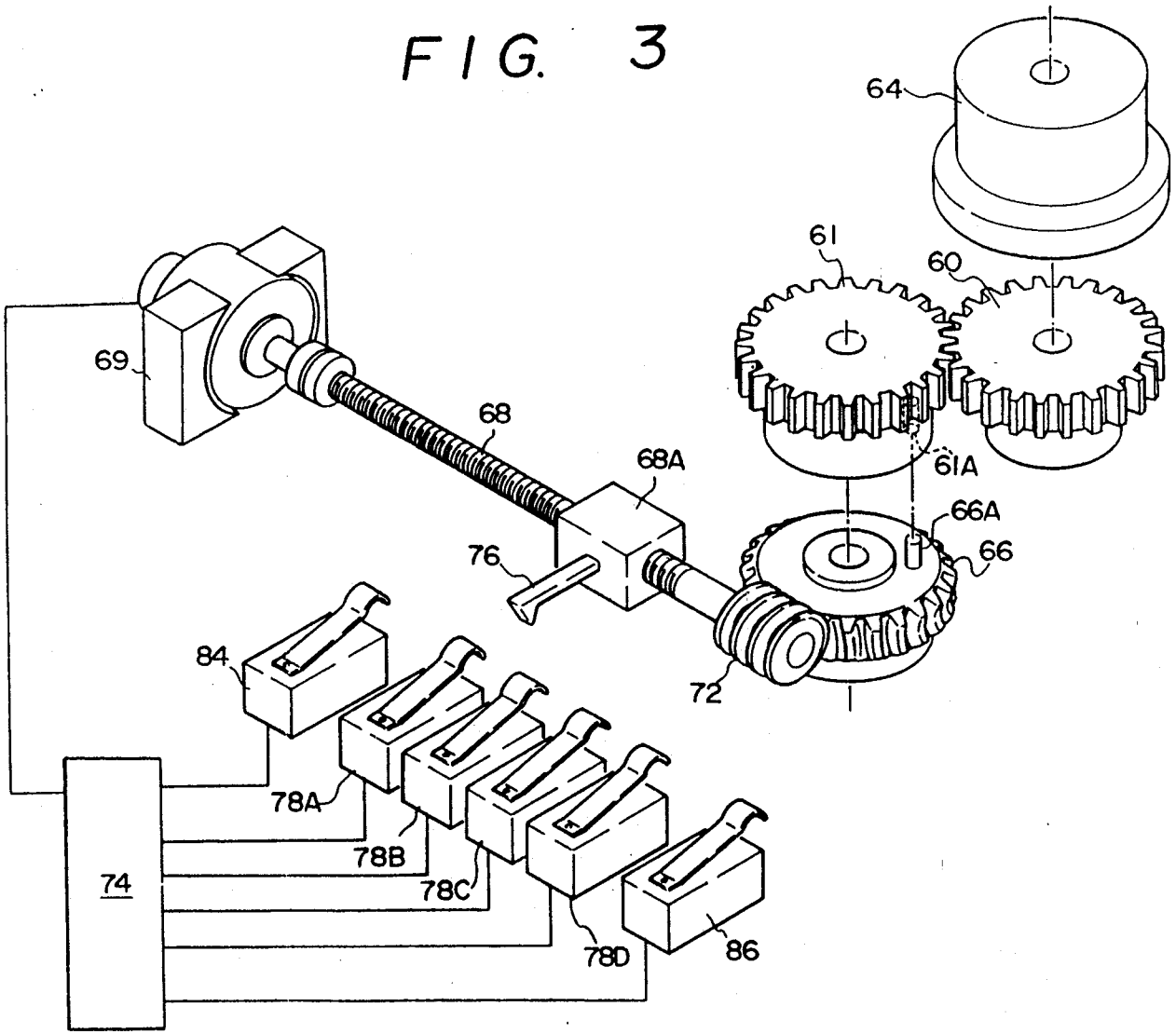
FIG. 3 is an exploded perspective view showing a drive part of a width guide body.

A spur gear 60, which is fixedly secured near the end of the width guide drive shaft 58 above the surface of the liquid, is engaged with a spur gear 61 supported at one axial end by the arm 18. As shown in FIG. 3, the spur gear 61 is connected to a worm wheel 66 through a connecting pin 66A extending from the worm wheel 66, and the worm wheel 66 is supported at one axial end by the bracket 20 of the treatment tank. That is, the connecting pin 66A extends from the worm wheel 66 in a direction parallel to the axis thereof, and is inserted into a circular hole 61A formed in the spur gear 61. Accordingly, when the rack body 12 is in the treating tank as shown in FIG. 1, the worm wheel 66 is connected to the spur gear 61, whereas, when the rack body 12 is raised out of the treating tank, the worm wheel 66 and spur gear 61 are disconnected from each other. When the rack body is put back into the tank and reconnection is accomplished, the spur gear 61 is reconnected to the worm wheel 66 at the same rotational position, so as to avoid introduction of a phase shift.

As shown in FIG. 3, the worm wheel 66 is engaged with a worm gear 72 of a motor drive shaft 68. A motor 69 connected to the motor drive shaft 68 receives a driving force from a controller 74 to rotate. (The controller 74 also controls a motor for driving the rotation of the roller drive shaft 32, not shown in FIG. 3)

The midsection of the motor drive shaft 68 is threadedly engaged with a block 68A whose rotation is prevented, and an arm 76 extending from the block 68A corresponds to a plurality of limit switches 78A, 78B, 78C and 78D. The respective limit switches are positioned so as to correspond to arm 76 when the width guide bodies 48 are adjusted to adjusting positions $S_A$, $S_B$, $S_C$, and $S_D$ respectively. More specifically, the limit switch 78A corresponds to the adjusting position $S_A$ of the width guide bodies 48, which corresponds to the minimum width of the photosensitive material F to be conveyed, and the limit switch 78D corresponds to the adjusting position $S_D$ of the width guide bodies 48, which corresponds to the maximum width of the photosensitive material F.

The limit switch 78D is used as a home position. Limit switches 84 and 86 are provided adjacent to "minimum width" limit switch 78A and "maximum width" limit switch 78D, respectively, to detect overstroke positions $S_E$ and $S_F$. If the limit switches 84 and 86 detect the arm 76, the controller will actuate an alarm (not shown).

The operation of the present invention will be explained hereinafter.

When a worker turns on the main power source of the developing apparatus, the controller 74 drives the motor 69 to reciprocatively move the arm 76 to a position corresponding to the limit switch 78D. Thereafter, the controller 74 moves the arm 76 back and forth in a plurality of standard length strokes from the limit switch 78A to the limit switch 78D, and then returns the arm to the position corresponding to the limit switch 78D.

Then, according to a photosensitive material width dimension which is either input by the worker or automatically detected, the controller drives the motor 69 until the arm 76 is in a position corresponding to the appropriate one of the limit switches 78A through 78D.

Thereafter, when the roller drive shaft 42 is driven, the photosensitive material F is moved while being held by the conveyor roller 24, and both widthwise edges thereof are guided by the width guide bodies 48 to perform developing.

In order to prevent the deposit of a precipitate from the treatment liquid on the portions of drive shaft 32 and motor drive shaft 58 located above the liquid level, the shaft centers of these shafts are kept vertical even when rotated, so that the treatment liquid P will not climb up the portions thereof above the liquid surface. As an alterative to this arrangement in which the shaft centers of the roller drive shaft 32 and the motor drive shaft 58 are exactly vertical, the shafts may be somewhat inclined from the vertical, while still being upright enough to prevent the treatment liquid from climbing up their sides.

Thus, in the present embodiment, the width guide drive shaft 58 is forcibly moved by a distance comprising the maximum stroke ($S_A$ to $S_D$) of the normal range for adjusting the position of the width guides in correspondence to the range of widths of the photosensitive material F to be conveyed, before the start of the developing apparatus operation, so that any precipitate previously accumulated on the engaging portions of the screw shaft 52 and the width guide bodies 48, that is, on the threadedly engaging portions thereof, is reliably removed. Accordingly, the width guide bodies 48 can be moved smoothly when the motor 69 is driven for the purpose of adjusting their position, since no precipitate can accumulate over a long period which would otherwise impede the movement of the width guide bodies 48.

When the width of the photosensitive material F to be guided is changed, the width guide bodies 48 are automatically moved by a driving force from the motor 69 to one of the adjusting positions $S_A$ through $S_D$.

As alternatives to the above-described arrangement in which the controller 74 causes the motor 69 to forcibly move the width guide drive shaft when -the developing operation of the developing- apparatus is started, other arrangements are acceptable such as: the motor 69 automatically moves the width guide drive shaft for the cleaning operation after a specified time period has elapsed, or after a specified volume of work, i.e., a specified number of sheets, or a specified length or area of photosensitive material F, has been treated.

Although, in the above-described embodiment, before the start of a job, the motor 69 is typically driven so as to move the arm 76 to a position corresponding to one of the limit switches 78A through 78D, (that is, to an adjustment position (one of $S_A$ through $S_D$) corresponding to one of the dimensions in the predetermined range of dimensions from the maximum dimension through minimum dimension of the photosensitive material F), the motor 69 may also move the arm 76 in a stroke exceeding the range of adjusting positions ($S_A$ through $S_D$) corresponding to the width of normal photosensitive material.

If the sensitized material F becomes jammed while being held and conveyed by the conveyor roller 24, the arm 76 can be moved by driving the motor to a position corresponding with the limit switch 86 so as to separate the width guide bodies 48 from each other to the maximum distance. At that time, the rack body 12 is capable of being raised a little so as to release the engagement between the spur gear 61 and the worm wheel 66, and between the helical gears 38 and 42, and then, by manually turning the turning handle 36, the sensitized material F can be removed from the conveyor roller 24. Also, before and after the rack body 12 is raised a little, the width guide bodies 48 can be moved by manually turning the turning handle 64.

Then, the rack body, after having been used for a specified period, is taken out of the treatment tank and put into a washing tank for washing. At this point, the washing can be performed while moving the conveyor rollers 24 and the width guide bodies 48 by manually turning the turning handles 36 and 64, so as to allow every nook and cranny thereof to be washed.

Further, the present invention can be applied to various treatment tanks such as a bleaching tank, as well as to a developing tank.

What is claimed is:

1. A method of operating a conveyor rack which guides and conveys photosensitive material within a treatment area and which is used for an automatic developing apparatus in which the position of width guides for guiding the widthwise edges of said photosensitive material is adjustable by drive means according to the width of said photosensitive material, comprising the following step:

driving said width guides with said drive means within a given position-adjusting range at a specified interval to remove a precipitate which has precipitated out of a treatment liquid and which has been deposited on said drive means.

2. A method of operating a conveyor rack as in claim 1, wherein said driving step includes driving said width guides at specified time intervals.

3. A method of operating a conveyor rack as in claim 1, further comprising the step of heating said treatment liquid.

4. A method of operating a conveyor rack as in claim 1, wherein said driving step is conducted after a stop signal for terminating the operation of said automatic developing apparatus has been generated.

5. A method of operating a conveyor rack as in claim 1, wherein said driving step includes driving said width guides for the entire distance of a previously specified position adjusting range, and then returning said width guides to the original position thereof.

6. A method of operating a conveyor rack as in claim 1, wherein said driving step includes driving said width guides from a position corresponding to a minimum width of said photosensitive material to be conveyed to a position corresponding to a maximum width thereof.

7. A method of operating a conveyor rack as in claim 6, wherein said driving step includes driving said width guides, whose home position is made to be said position corresponding to a maximum width, to said position corresponding to a minimum width at the end of each said specified interval and thereafter returning said width guides to said home position.

8. A method of operating a conveyor rack as in claim 1, further comprising the step of detecting the position of said width guides using limit switches.

9. A method of operating a conveyer rack as in claim 1, further comprising the step of sounding an alarm if said width guides move out of said position adjusting range.

10. A method of operating a conveyer rack as in claim 1, wherein said driving step includes driving said width guides a plurality of times at said specified interval.

11. A method of operating a conveyer rack as in claim 1, wherein said driving step includes driving said width guides every time a specified length of photosensitive material has been treated.

12. A method of operating a conveyer rack as in claim 1, wherein said driving step includes driving said width guides every time a specified area of photosensitive material has been treated.

13. A method of operating a conveyer rack as in claim 1, wherein said driving step includes driving said width guides beyond said position adjusting range at said specified interval.

14. A conveyor rack which guides and conveys photosensitive material within a treatment tank, comprising;

a rack body, part of which is immersed in said treatment tank;

holding rollers supported by said rack body, for holding and conveying said sensitized material through a treatment liquid;

a roller drive shaft having one end connectd to said holding roller and the other end extending out of said treatment liquid to serve as a drive-source connecting part;

a manual roller-turning handle mounted on said rack body and connected to said one end of said roller drive shaft extending out of said treatment liquid;

width guides, supported by said rack body, for guiding the widthwise edges of said photosensitive material through said treatment liquid, and whose positions are adjustable according to the width of said photosensitive material;

a width guide drive shaft having one end connected to said width guides and the other end extending above the level of said treatment liquid; and a manual width guide adjusting handle connected to said one end of said width guide drive shaft extending above the level of said treatment liquid.

15. A conveyor rack for conveying photosensitive material as in claim 14, wherein portions at one end of said roller drive shaft and of said width guide shaft vertically penetrate and extend beyond the surface of said treatment liquid.

16. A conveyor rack for conveying photosensitive material as in claim 14, wherein said width guides are arranged such that width guide bodies corresponding to respective widthwise edges of said photosensitive material are driven by a combination of screws and nuts in a widthwise direction, that is, transversely across said photosensitive material and at a night angle to the direction of conveyance thereof.

17. A conveyor rack for conveying a photosensitive material as in claim 15, wherein said roller drive shaft and said width guide shaft stand upright and extend above the surface of said treatment liquid and said handles are connected to the respective upper ends of said roller drive shaft and said width guide shaft.

18. A conveyor rack for conveying a photosensitive material as in claim 17, wherein the upper ends of said roller drive shaft and said width guide shaft extending above the surface of said treatment liquid receive a driving force from a drive source.

19. A conveyor rack for conveying photosensitive material as in claim 18, wherein the upper portions of said two shafts extending above the surface of the treatment liquid receive a driving force through a combination of helical gears from the drive source.

20. A conveyor rack for conveying a photosensitive material as in claim 14, wherein said roller drive shaft is connected to the drive source through connecting means for enabling interruption of the transmission of the drive force upon raising of the rack body.

* * * * *